US010195499B2

(12) United States Patent
Stokke et al.

(10) Patent No.: US 10,195,499 B2
(45) **Date of Patent: *Feb. 5, 2019**

(54) GOLF CLUB HEADS WITH RIBS AND RELATED METHODS

(71) Applicant: KARSTEN MANUFACTURING CORPORATION, Phoenix, AZ (US)

(72) Inventors: Ryan M. Stokke, Anthem, AZ (US); Martin R. Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/704,945

(22) Filed: Sep. 14, 2017

(65) Prior Publication Data

US 2018/0001161 A1 Jan. 4, 2018

Related U.S. Application Data

(63) Continuation of application No. 15/186,227, filed on Jun. 17, 2016, now Pat. No. 9,776,056, which is a continuation of application No. 14/260,694, filed on Apr. 24, 2014, now Pat. No. 9,393,465.

(60) Provisional application No. 61/818,832, filed on May 2, 2013.

(51) Int. Cl.
*A63B 53/04* (2015.01)

(52) U.S. Cl.
CPC .... *A63B 53/0466* (2013.01); *A63B 2053/045* (2013.01); *A63B 2053/0408* (2013.01); *A63B 2053/0433* (2013.01); *A63B 2053/0437* (2013.01)

(58) Field of Classification Search
CPC ..... A63B 53/0466; A63B 2053/0408; A63B 2053/0433; A63B 2053/045; A63B 2053/0437
USPC ..... 473/324–350, 287–292
See application file for complete search history.

(56) References Cited

U.S. PATENT DOCUMENTS

| | | | |
|---|---|---|---|
| 4,214,754 | A | 7/1980 | Zebelean |
| 5,067,715 | A | 11/1991 | Schmidt et al. |
| 5,921,872 | A | 7/1999 | Kobayashi |
| 6,059,669 | A | 5/2000 | Pearce |
| 6,645,087 | B2 | 11/2003 | Yabu |
| 6,776,725 | B1 | 8/2004 | Miura et al. |
| 6,783,465 | B2 | 8/2004 | Matsunaga |
| 6,852,038 | B2 | 2/2005 | Yabu |
| 7,051,416 | B2 | 5/2006 | Yabu |
| 7,108,614 | B2 | 9/2006 | Lo |
| 7,250,007 | B2 | 7/2007 | Lu |
| 7,258,624 | B2 | 8/2007 | Kobayashi |

(Continued)

FOREIGN PATENT DOCUMENTS

| | | |
|---|---|---|
| JP | 2001095957 | 4/2001 |

*Primary Examiner* — Sebastiano Passaniti

(57) ABSTRACT

A golf club head comprising a ribbed region on at least one of a heel portion, a toe portion, sole, or crown. The ribbed region comprises a ribbed wall with an interior surface facing an interior of the golf club head, and a ribbed wall exterior facing an exterior of the golf club head. The ribbed region further comprises at least one rib protruding from the ribbed region. The first rib comprises a first rib length measured along a rib centerline of the first rib, a first rib interior section located at the ribbed wall interior surface, and a first rib exterior section located at the ribbed wall exterior surface.

20 Claims, 6 Drawing Sheets

(56) References Cited

U.S. PATENT DOCUMENTS

| | | | | |
|---|---|---|---|---|
| 7,281,992 | B2 | 10/2007 | Tseng | |
| 7,448,964 | B2 | 11/2008 | Schweigert | |
| 7,641,568 | B2 | 1/2010 | Hoffman | |
| 7,798,203 | B2 | 9/2010 | Schweigert | |
| 7,887,433 | B2 | 2/2011 | Hoffman | |
| 8,007,369 | B2 | 8/2011 | Soracco | |
| 8,172,697 | B2 | 5/2012 | Cackett et al. | |
| 8,206,242 | B2 | 6/2012 | Jertson | |
| 8,308,582 | B2 | 11/2012 | Tanimoto | |
| 8,414,421 | B2 | 4/2013 | Jertson | |
| 8,540,890 | B2 | 9/2013 | Baklanov | |
| 8,790,196 | B2 | 7/2014 | Solheim | |
| 9,393,465 | B2 * | 7/2016 | Stokke | A63B 53/0466 |
| 9,421,430 | B2 | 8/2016 | Yamamoto | |
| 9,694,254 | B2 * | 7/2017 | Ashino | A63B 53/04 |
| 9,776,056 | B2 * | 10/2017 | Stokke | A63B 53/0466 |
| 9,925,430 | B2 * | 3/2018 | Stokke | A63B 53/0466 |
| 2006/0293118 | A1 | 12/2006 | Meyer et al. | |
| 2007/0155533 | A1 | 7/2007 | Solheim | |
| 2008/0045356 | A1 * | 2/2008 | Lin | A63B 53/0466 473/346 |
| 2008/0070721 | A1 | 3/2008 | Chen et al. | |
| 2011/0306441 | A1 | 12/2011 | Tsukada et al. | |
| 2013/0065705 | A1 | 3/2013 | Morales et al. | |
| 2015/0298196 | A1 * | 10/2015 | Su | B21K 17/00 72/342.8 |

* cited by examiner

GOLF CLUB HEADS WITH RIBS AND RELATED METHODS

CLAIM OF PRIORITY

This is a continuation of U.S. Non-Provisional application Ser. No. 15/186,227, filed Jun. 17, 2016, which is a continuation of U.S. Non-Provisional application Ser. No. 14/260,694, filed Apr. 24, 2014, which claim the benefit of U.S. Provisional Patent Application No. 61/818,832, filed on May 2, 2013, the entire contents of which are fully incorporated herein.

TECHNICAL FIELD

The present invention generally relates to golf equipment and, more particularly, to golf club heads.

BACKGROUND

Modern wood-type golf club heads are now almost exclusively made of metal rather than the persimmon wood that gave the clubs their name. These club heads are generally constructed as a hollow metal shell with a relatively thick face to withstand the ball impact and a relatively thick sole to withstand grazing impact with the ground as well as lowering the center of gravity of the club head. The remainder of the club head is manufactured as thin as possible so as to allow the maximum amount of material to be dedicated to the face and sole portions. Although the crown and skirt of a modern club head are quite thin, they still must be sufficiently rigid in the direction of the maximum stress in order to provide support for the face of the club head.

Considering the above, further developments with respect to thinning golf club features while still providing sufficient structural support will enhance the performance of golf clubs.

DESCRIPTION

Figure 1:
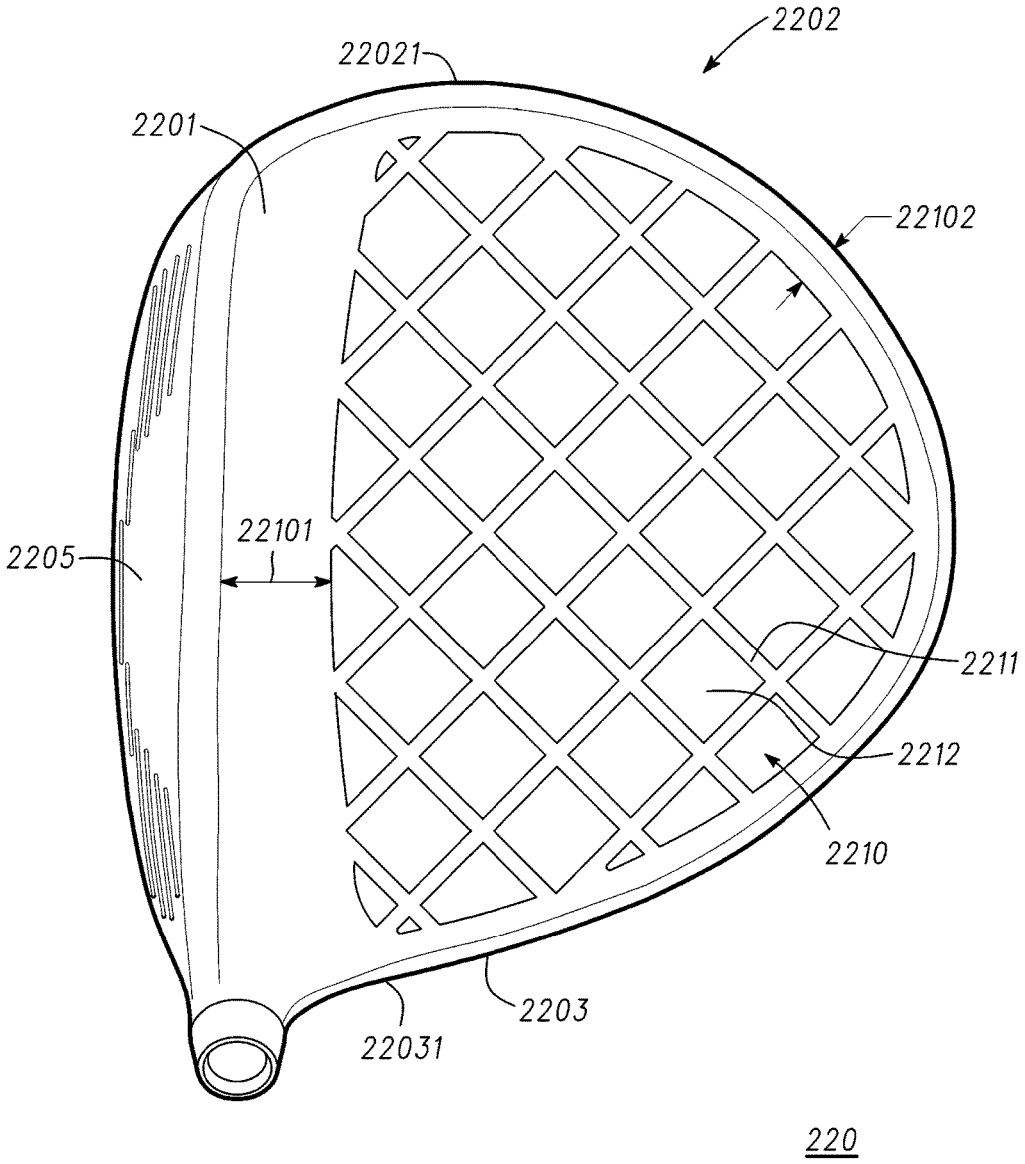
FIG. 1 illustrates a top view of a golf club head according to one embodiment of a golf club head comprising ribbed regions.

In one embodiment, a golf club head can comprise a heel portion comprising a heel end; a toe portion comprising a toe end; a sole; a crown; and a ribbed region comprising at least part of at least one of the heel portion, the toe portion, the sole, or the crown. The ribbed region can comprise a ribbed wall comprising a ribbed wall interior surface facing an interior of the golf club head, and a ribbed wall exterior surface facing an exterior of the golf club head opposite the ribbed wall interior surface. The ribbed region can also comprise one or more ribs protruding from the ribbed wall and comprising a first rib comprising a first rib length measured along a rib centerline of the first rib, a first rib interior section, located at the ribbed wall interior surface, and extended along the first rib length, and a first rib exterior section, located at the ribbed wall exterior surface, and extended along the first rib length opposite the first rib interior section.

In one example, a method for providing a golf club head can comprise providing a body comprising a heel portion, a toe portion, a sole, and a crown, and providing a ribbed region comprising a ribbed wall and one or more ribs protruding form the ribbed wall. The ribbed region can be located at at least part of at least one of the heel portion, the toe portion, the sole, or the crown. The ribbed wall can comprise a ribbed wall interior surface facing an interior of the golf club head, and a ribbed wall exterior surface facing an exterior of the golf club head opposite the ribbed wall interior surface. The one or more ribs can comprise a first rib comprising a first rib length measured along a rib centerline of the first rib, a first rib interior section, located at the ribbed wall interior surface, and extended along the first rib length, and a first rib exterior section, located at the ribbed wall exterior surface, and extended along the first rib length opposite the first rib interior section.

In one embodiment, a golf club head can comprise a heel portion comprising a heel end, a toe portion comprising a toe end, a sole, a crown, a skirt between the sole and the crown, a faceplate coupled to at least one of the sole or the crown at a club head front end, and a ribbed region comprising at least part of the crown. The ribbed region can comprise a ribbed wall comprising a ribbed wall interior surface facing an interior of the golf club head, a ribbed wall exterior surface facing an exterior of the golf club head opposite the ribbed wall interior surface, and a ribbed wall thickness of approximately 0.38 mm to approximately 0.76 mm between the ribbed wall interior surface and the ribbed wall exterior surface. The ribbed region can also comprise ribs protruding from the ribbed wall and comprising a first rib comprising: a first rib length measured along a rib centerline of the first rib, a first rib interior section, protruding from the ribbed wall interior surface by approximately 0.25 mm to approximately 1.27 mm throughout the first rib length, and a first rib exterior section, protruding from the ribbed wall exterior surface by approximately 0.25 mm to approximately 1.27 mm and opposite the first rib interior section throughout the first rib length.

Other examples and embodiments are further disclosed herein. Such examples and embodiments may be found in the figures, in the claims, and/or in the present description.

Figure 2:
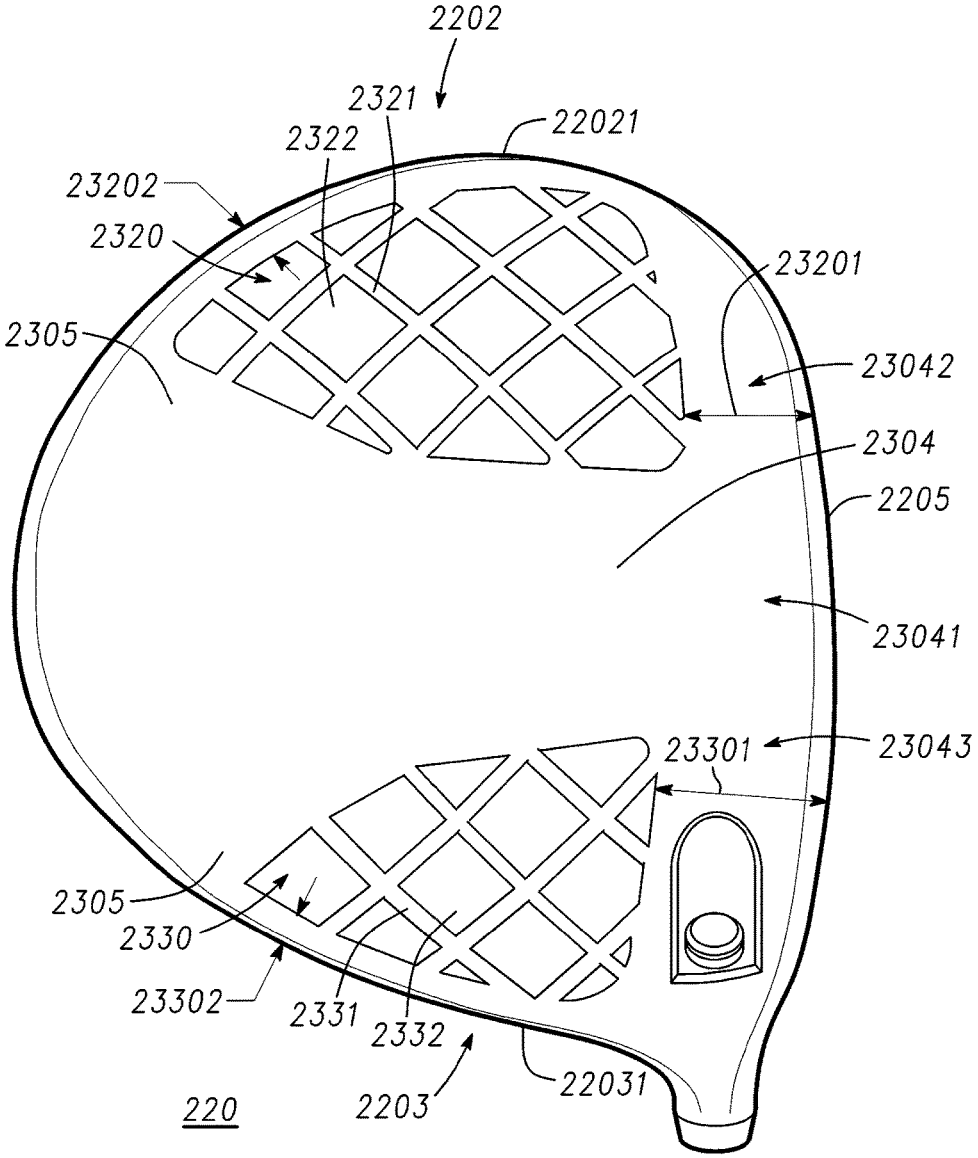
FIG. 2 illustrates a bottom view the golf club head of FIG. 1.
Figure 3:
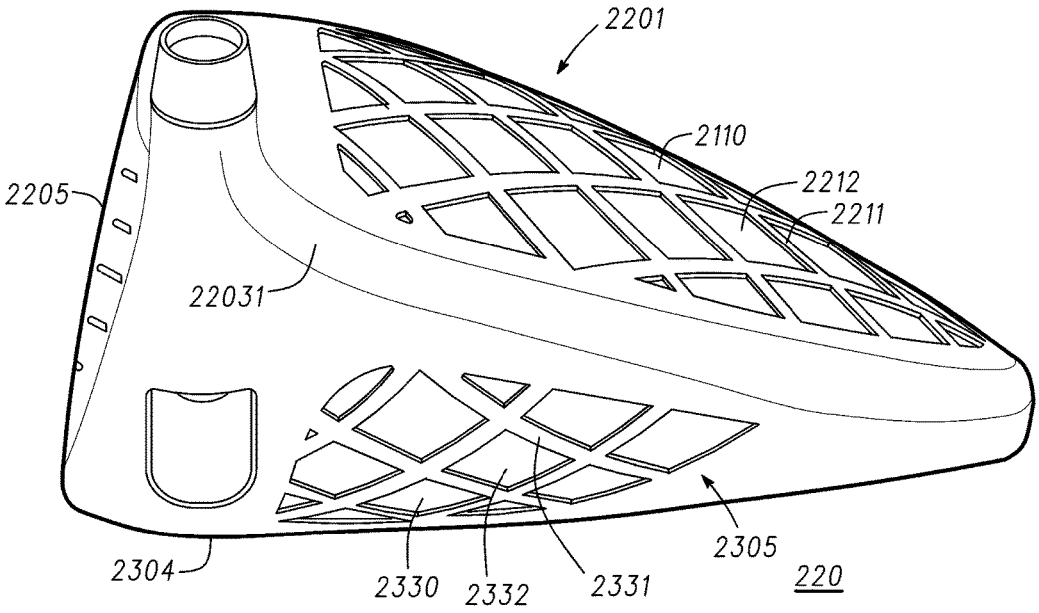
FIG. 3 illustrates a side view the golf club head of FIG. 1.

FIG. 1 illustrates a top view of golf club head 220. FIG. 2 illustrates a bottom view of golf club head 220. FIG. 3 illustrates a side view of golf club head 220.

Golf club head 220 comprises crown 2201, sole 2304, and faceplate 2205 coupled to at least one of sole 2304 or crown 2201 at a front end of golf club head 220. Golf club head 220 also has skirt 2305 in the present example, located between crown 2201 and sole 2304. Golf club head 220 comprises ribbed regions 2210, 2320, and 2330, where ribbed region 2210 comprises at least part of crown 2201, and where ribbed regions 2320 and 2330 comprise at least part of sole 2304 of golf club head 220. Ribbed regions 2320 and 2330 also extend to at least part of skirt 2305 in the present example. There can be other examples, however, where ribbed regions 2320 and/or 2330 can be limited to sole 2304 without extending to skirt 2305. Similarly, skirt 2305 can be optional.

In some embodiments, ribbed region 2210 can be separated from faceplate 2250 by distance 22101 of approximately 12.7 mm to approximately 76.4 mm, while ribbed regions 2320 and/or 2330 can be separated from faceplate 2250 by respective distance 23201 and/or 23301 of approximately 12.7 mm to approximately 76.4 mm. In the same or other embodiments, ribbed region 2210 can be separated from club head edge 2209 by distance 22102 of approximately 2.54 mm to approximately 12.7 mm, while ribbed regions 2320 and/or 2330 can be separated from club head edge 2209 by respective distance 23202 and/or 23302 of approximately 2.54 mm to approximately 12.7 mm. Club head edge 2209 can be defined along a heel, toe, and/or rear perimeter of golf club head 220 with respect to a top view (FIG. 1) and/or a bottom view (FIG. 2) of golf club head 220.

In the present example, sole 2304 comprises sole thick region 23041 located between heel portion 2203 and toe portion 2202 of golf club head 220. Sole 2304 also comprises sole-heel region 23043 located between sole thick region 23041 and heel end 22031, and sole-toe region 23042 located between sole thick region 23041 and toe end 22021 of golf club head 220. Sole thick region 23041 can have a thickness of approximately 0.5 mm to approximately 6.35 mm, where such thickness can be substantially constant or can be varied across sole thick region 23041 to position mass of golf club head 220 for improved performance and/or for structural integrity. Ribbed regions 2320 and 2330 are located outside sole thick region 23041, where ribbed region 2320 comprises at least part of sole-toe region 23042, and where ribbed region 2330 comprises at least part of sole-heel region 23043. There can be other embodiments, however, where sole 2304 lacks sole thick region 23041 between sole-toe region 23042 and sole-heel region 23043. In such embodiments, ribbed regions 2330 and 2340 may thus further extend towards each other and/or merge together at sole 2304.

Ribbed regions 2210, 2320, and 2330 comprise respective one or more ribs 2211, 2321, and 2331, and respective ribbed walls 2212, 2322, and 2332 in the present example. In the present embodiment, ribbed wall 2212 of ribbed region 2210 is thinner than the cross-sectional thickness of crown 2201 outside ribbed region 2210. Similarly, ribbed walls 2322 and 2332 of respective ribbed regions 2320 and 2330 are thinner than the cross-sectional thickness of sole thick region 23041 and other parts of sole 2304 outside ribbed regions 2320 and 2330. The reduced thickness of ribbed walls 2212, 2322, and 2332 permit a reduction of mass at respective ribbed regions 2210, 2320, and 2330, where such reduction in mass can be advantageous for making golf club head 220 lighter if desired, and/or for repositioning mass to other areas of golf club head 220 for better performance without increasing the total mass of golf club head 220.

Figure 4:
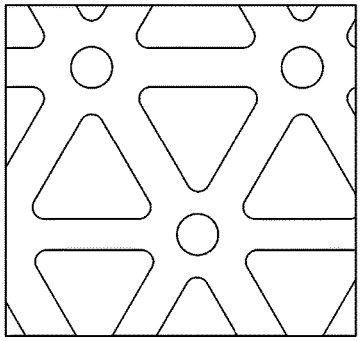
FIG. 4 illustrates an isogrid pattern suitable for one or more ribbed regions of a golf club head similar to the golf club head of FIG. 1.

The one or more ribs 2211, 2321, and 2331 can be arranged to reinforce golf club head 220 where respective ribbed regions 2210, 2320, and 2330 are located. Ribs 2211, 2321, and 2331 are arranged in a diamond-grid pattern in the present example, where each diamond of the diamond-grid pattern is a square. Other arrangements are possible, however, for the one or more ribs 2211, 2321, and/or 2331. For example, one arrangement can comprise a diamond-grid pattern with one or more diamonds comprising a parallelogram different than a square, such as a rectangle, rhomboid, or rhombus, and/or other diamond shape(s). Other arrangements can comprise one or more polygonal shapes comprising triangles, pentagons, hexagons, and/or other polygons. Furthermore, in some embodiments, only complete shapes are used in the arrangement, while in other embodiments portions of the shapes are used at the perimeter of the arrangement and/or at other portions of the arrangement. Also, other arrangements can use two or more shapes. One embodiment can comprise a pattern similar to the isogrid pattern shown in FIG. 4. There can also be arrangements where one or more ribs can be curved. Furthermore, although ribs 2211, 2321, and 2331 are shown in FIGS. 22-24 as comprising a plurality of ribs, there can be embodiments where ribs 2211, 2321, and/or 2331 of ribbed regions 2210, 2320, and/or 2330 can comprise or be described to comprise a single rib.

FIGS. 26-33 illustrate several cross-sectional views of respective ribbed regions, which can correspond to portions of one or more of ribbed regions 2210, 2320, and/or 2330 (FIGS. 22-24). The cross-sectional views of the ribbed regions shown in FIGS. 26-33 comprise ribs that can correspond to one or more ribs of ribs 2211, 2321, and/or 2331 (FIGS. 22-24).

Figure 5:
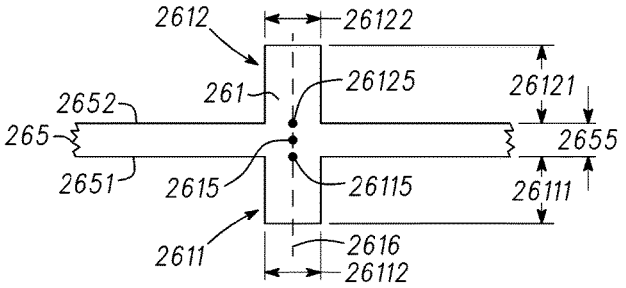
FIG. 5 illustrates a transverse cross-sectional view of a golf club head ribbed region.
Figure 6:
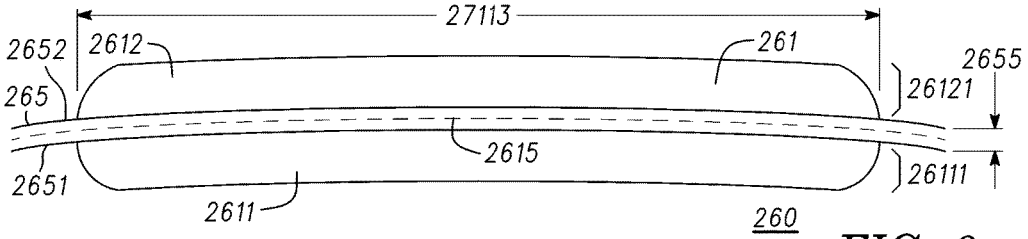
FIG. 6 illustrates a longitudinal cross-sectional view of the ribbed region of FIG. 5.

FIG. 5 illustrates a transverse cross-sectional view of ribbed region 260. FIG. 6 illustrates a longitudinal cross-sectional view of ribbed region 260. In the example of FIGS. 26-27, ribbed region 260 comprises ribbed wall 265, which can correspond to ribbed wall 2212 of ribbed region 2210 (FIG. 1), to ribbed wall 2322 of ribbed region 2320 (FIG. 2), and/or to ribbed wall 2332 of ribbed region 2330 (FIG. 2). Ribbed wall 265 comprises ribbed wall interior surface 2651 and ribbed wall exterior surface 2652 opposite each other, where ribbed wall interior surface 2651 and ribbed wall exterior surface 2652 can respectively face an interior or an exterior of a golf club head like golf club head 220 (FIGS. 22-24).

Ribbed region 260 also comprises rib 261 protruding from ribbed wall 265, where rib 261 can correspond to one of the one or more ribs 2211 of ribbed region 2210 (FIG. 1), to one or the one or more ribs 2321 of ribbed region 2320 (FIG. 2), and/or to one of the one or more ribs 2331 of ribbed region 2330 (FIG. 2). As can be seen in the longitudinal cross-sectional view of FIG. 6, rib 261 comprises rib length 27113 from end-to-end thereof, where rib length 27113 extends along rib centerline 2615 of rib 261, and where rib centerline 2615 traverses along the center of rib 261 within ribbed wall 265.

In the present example, rib 261 comprises rib interior section 2611 located at ribbed wall interior surface 2651, and rib exterior section 2612 located at ribbed wall exterior surface 2652. Rib interior section 2611 comprises rib interior height 26111 and rib interior width 26112, and extends along rib exterior section centerline 26125 parallel to rib centerline 2615. Rib exterior section 2612 comprises rib exterior height 26121 and rib interior width 26122, and extends along rib interior section centerline 26115 parallel to rib centerline 2615. Rib interior section 2611 and rib exterior section 2612 are thus aligned with rib centerline 2615.

Rib 2615 comprises rib centerplane 2616, which extends along rib centerline 2615 substantially orthogonal to ribbed wall 265. In the present example, rib interior section 2611 and rib exterior section 2612 are collinear to each other, where rib exterior section centerline 26125 and rib interior section centerline 26115 both extend along rib centerplane 2616.

Figure 15:
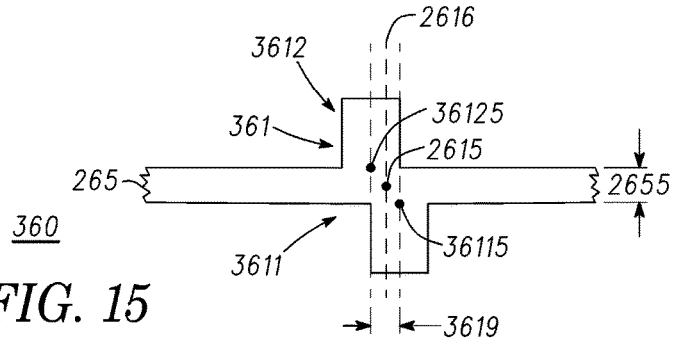
FIG. 15 illustrates a transverse cross-sectional view of another golf club head ribbed region.

There can be other examples, however, where the rib interior and exterior sections of a rib can be offset from each other rather than collinear. Skipping to FIG. 15, a transverse cross-sectional view of ribbed region 360 is illustrated therein. Ribbed region 360 comprises rib 361, which can be similar to rib 261 or ribbed region 260 (FIG. 1). Rib 361 comprises rib centerplane 2616 extended along rib centerline 2615. Rib 361 also comprises rib exterior section 3612 extended along rib exterior section centerline 36125 parallel to rib centerline 2615, and rib interior section 3611 extended along rib interior section centerline 36115 parallel to rib centerline 2615. Rib exterior section 3612 and rib interior section 3611 are both traversed by rib centerplane 2616, but rib exterior section centerline 36125 and rib interior section centerline 36115 are offset from rib centerline 2615. In the present example, offset distance 3619 between rib exterior section centerline 36125 and rib interior section centerline 36115, measured orthogonal to rib centerline 2616, can be up to 5.08 mm.

Backtracking to the example of FIG. 1, each of rib interior section 2611 and rib exterior section 2612 can extend along rib length 27113 in a substantially consistent manner, where rib interior section 2611 protrudes past ribbed wall interior surface 2651 throughout rib length 27113, where rib exterior section 2612 protrudes past ribbed wall exterior surface 2652 throughout rib length 27113, and where rib interior height 26111 and rib exterior height 26121 remain substantially constant along a majority of rib length 27113. There can be other examples, however, where rib interior height 26111 and/or rib exterior height 26121 can vary along rib length 27113. Similarly, there can be other examples where rib interior width 26112 and/or rib exterior width 26122 can vary along rib length 27113.

Ribbed wall 265 comprises ribbed wall thickness 2655 between ribbed wall interior surface 2651 and ribbed wall exterior surface 2652, where ribbed wall thickness 2655 is approximately 0.38 mm to approximately 0.76 mm in the present embodiment but can be approximately 0.13 mm to approximately 1.27 mm in the same or other embodiments. In the same or other embodiments, rib interior height 26111 and/or rib exterior height 26121 of rib 261 can be up to approximately 2.5 mm. For instance, rib interior height 26111 and/or rib exterior height 26121 of rib 261 can be approximately 0.25 mm to approximately 1.27 mm in some implementations. In the same or other embodiments, rib interior width 26112 and/or rib exterior width 26122 of rib 261 can be up to approximately 5.1 mm. For instance, rib interior width 26112 and/or rib exterior width 26122 of rib 261 can be approximately 0.38 mm to approximately 3.81 mm in some implementations.

Figure 7:
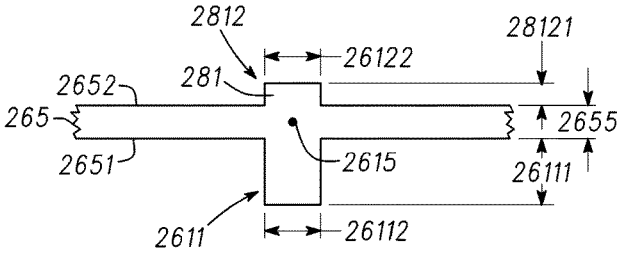
FIG. 7 illustrates a transverse cross-sectional view of another golf club head ribbed region.
Figure 8:
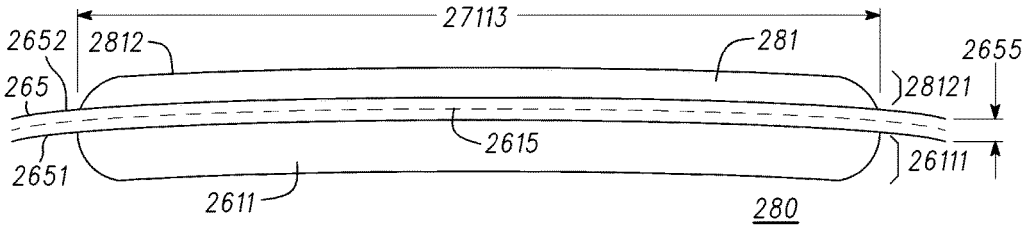
FIG. 8 illustrates a longitudinal cross-sectional view of the ribbed region of FIG. 7.

FIG. 7 illustrates a transverse cross-sectional view of ribbed region 280. FIG. 8 illustrates a longitudinal cross-sectional view of ribbed region 280. In the example of FIGS. 28-29, ribbed region 280 also comprises ribbed wall 265 as in the example of FIGS. 26-27. Ribbed region 280 also comprises rib 281 protruding from ribbed wall 265, where rib 281 can correspond to one of the one or more ribs 2211 of ribbed region 2210 (FIG. 1), to one or the one or more ribs 2321 of ribbed region 2320 (FIG. 2), and/or to one of the one or more ribs 2331 of ribbed region 2330 (FIG. 2). In the present example, rib 281 comprises rib interior section 2611 located at ribbed wall interior surface 2651, and rib exterior section 2812 located at ribbed wall exterior surface 2652.

Figure 9:
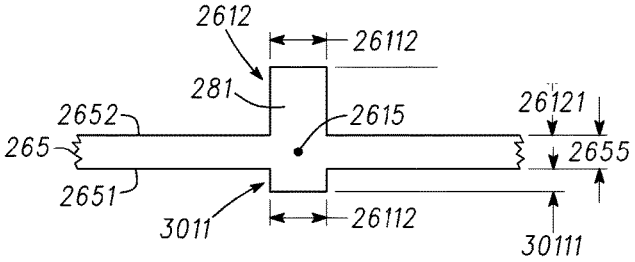
FIG. 9 illustrates a transverse cross-sectional view of another golf club head ribbed region.

Rib 281 can be similar to rib 261 (FIGS. 6 and 7) in many respects, but can differ with respect to the rib interior and exterior heights. Although rib interior height 26111 and rib exterior height 26121 of rib 261 are shown in FIGS. 6 and 7 as substantially equal to each other, corresponding heights for rib 281 (FIGS. 8 and 9) can differ from each other. For instance, rib interior section 2611 of rib 281 comprises rib interior height 26111, while rib exterior section 2812 comprises rib exterior height 28121, where rib interior height 26111 of rib interior section 2611 is greater than rib exterior height 28121 of rib exterior section 2812. Rib exterior height 28121 can be approximately 0.51 mm and rib interior height 26111 can be greater than 0.76 mm in the present example, but there can be embodiments where rib exterior height 28121 can be approximately 0.25 mm to approximately 0.76 mm. Other features of rib 281 can be similar to corresponding features of rib 261 as described above. For example, rib 281 is shown in FIGS. 8 and 9 aligned with rib centerline 2615 and extending along rib length 27113 in a substantially consistent manner, where rib interior section 2611 protrudes past ribbed wall interior surface 2651 throughout rib length 27113, where rib exterior section 2812 protrudes past ribbed wall exterior surface 2652 throughout rib length 27113, and where rib interior height 26111 and rib exterior height 28121 remain substantially constant along a majority of rib length 27113. There can be other examples, however, where rib interior height 26111 and/or rib exterior height 28121 can vary along rib length 27113. Similarly, there can be other examples where rib interior width 26112 and/or rib exterior width 26122 can vary along rib length 27113.

Figure 10:
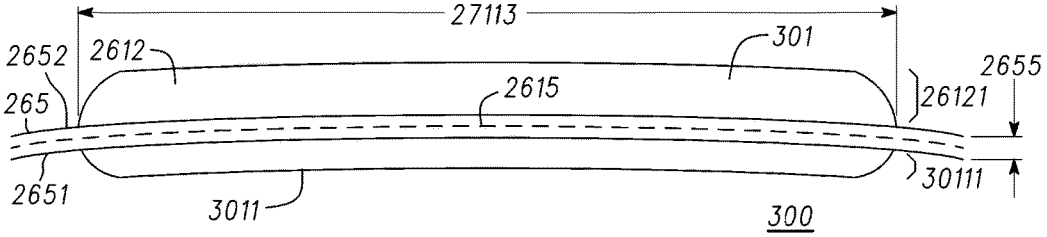
FIG. 10 illustrates a longitudinal cross-sectional view of the ribbed region of FIG. 9.
Figure 11:
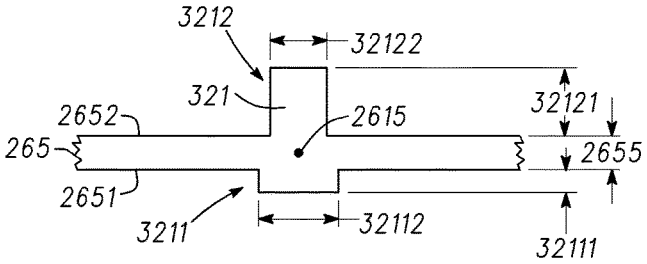
FIG. 11 illustrates a transverse cross-sectional view of another golf club head ribbed region.

FIG. 9 illustrates a transverse cross-sectional view of ribbed region 300. FIG. 10 illustrates a longitudinal cross-sectional view of ribbed region 300. In the example of FIGS. 10-11, ribbed region 300 also comprises ribbed wall 265 as in the examples of FIGS. 6-9. Ribbed region 300 also comprises rib 301 protruding from ribbed wall 265, where rib 301 can correspond to one of the one or more ribs 2211 of ribbed region 2210 (FIG. 1), to one or the one or more ribs 2321 of ribbed region 2320 (FIG. 2), and/or to one of the one or more ribs 2331 of ribbed region 2330 (FIG. 2). In the present example, rib 301 comprises rib interior section 3011 located at ribbed wall interior surface 2651, and rib exterior section 2612 located at ribbed wall exterior surface 2652.

Rib 301 can be similar to rib 261 (FIGS. 5-6) and to rib 281 (FIGS. 7-8) in many respects, but can differ with respect to rib interior and exterior heights. In the present example, rib interior section 3011 of rib 301 comprises rib interior height 30111, while rib exterior section 2612 comprises rib exterior height 26121, where rib exterior height 26121 of rib exterior section 2612 is greater than rib interior height 30111 of rib interior section 3011.

Rib interior height 30111 can be approximately 0.51 mm and rib exterior height 26121 can be greater than 0.76 mm in the present example, but there can be embodiments where rib interior height 30111 can be approximately 0.25 mm to approximately 0.76 mm.

Other features of rib 301 can be similar to corresponding features of rib 261 (FIGS. 5-6) and/or 281 (FIGS. 7-8) as described above. For example, rib 301 is shown in FIGS. 9-10 extending aligned with rib centerline 2615 and along rib length 27113 in a substantially consistent manner, where rib interior section 3011 protrudes past ribbed wall interior surface 2651 throughout rib length 27113, where rib exterior section 2612 protrudes past ribbed wall exterior surface 2652 throughout rib length 27113, and where rib interior height 30111 and rib exterior height 26121 remain substantially constant along a majority of rib length 27113. There can be other examples, however, where rib interior height 30111 and/or rib exterior height 26121 can vary along rib length 27113. Similarly, there can be other examples where rib interior width 26112 and/or rib exterior width 26122 can vary along rib length 27113.

FIG. 11 illustrates a transverse cross-sectional view of ribbed region 320, which comprises rib 321 protruding from ribbed wall 265, where rib 321 can correspond to one of the one or more ribs 2211 of ribbed region 2210 (FIG. 1), to one or the one or more ribs 2321 of ribbed region 2320 (FIG. 2), and/or to one of the one or more ribs 2331 of ribbed region 2330 (FIG. 2). In the present example, rib 321 comprises rib interior section 3211 located at ribbed wall interior surface 2651, and rib exterior section 3212 located at ribbed wall exterior surface 2652.

Rib 301 can be similar to rib 261 (FIGS. 26-27), to rib 281 (FIGS. 28-29), and/or to rib 301 (FIGS. 30-31) in many respects, but can differ with respect to rib interior and exterior heights and/or widths. In the present example, rib interior section 3211 of rib 321 comprises rib interior height 32111 and rib interior width 32112, while rib exterior section 3212 comprises rib exterior height 32121 and rib exterior width 32122. In some examples, rib interior height 32111 can comprise a height range similar to that for rib interior height 26111 (FIGS. 26-29) or rib interior height 30111 (FIGS. 30-31), while rib exterior height 32121 can comprise a height range similar to that of rib exterior height 26121 (FIGS. 26-27, 30-31) or rib exterior height 28121 (FIGS. 28-29). In the same or other examples, rib interior width 32112 can comprise a width range similar to or smaller than that for rib interior width 26112 (FIGS. 26, 28, 30), while rib exterior width 32122 can comprise a width range similar to or larger than that for rib exterior width 26122 (FIGS. 26, 28, 30).

As seen in FIG. 11, rib exterior height 32121 of rib exterior section 3212 can be greater than rib interior height 32111 of rib interior section 3211. In addition, rib interior width 32112 of rib interior section 3211 can be greater than rib exterior width 32122 of rib exterior section 3212. For example, rib interior width 32112 can be approximately 0.76 mm to approximately 1.9 mm while rib exterior width 32122 can be less than 0.76 mm.

There also can be examples with different rib height or width arrangements. For instance, in one embodiment, rib exterior width 32122 for rib exterior section 3212 can, instead, be greater than rib interior width 32112 for rib interior section 3211. For instance, rib exterior width 32122 can be approximately 0.76 mm to approximately 1.9 mm while rib interior width 32112 can be less than 0.76 mm. In the same or other embodiments, rib interior height 30111 for rib interior section 3211 can, instead, be greater than rib exterior height 32121 for rib exterior section 3212.

Figure 12:
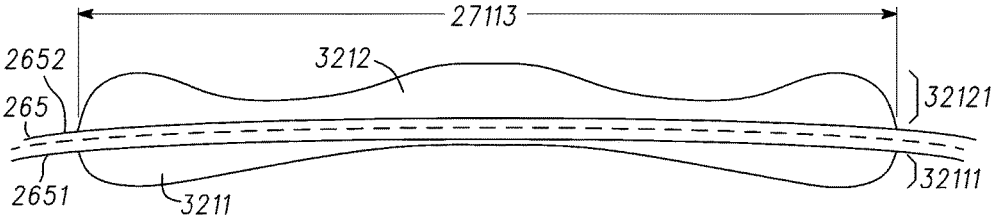
FIG. 12 illustrates a longitudinal cross-sectional view of the ribbed region of FIG. 11.

In the present embodiment, rib 301 extends aligned with rib centerline 2615 and along rib length 27113 in a varying manner as seen in FIG. 12, where each of interior rib height 32111 and exterior rib height 32121 varies along rib length 27113. There also can be embodiments, however, where only one of interior rib height 32111 or exterior rib height 32121 varies along rib length 27113. Nevertheless, there also can be embodiments where rib 301 can extend along rib length 27113 in a substantially consistent manner as described above with respect to rib 261 (FIGS. 5-6), rib 281 (FIGS. 7-8), and/or 301 (FIGS. 9-10).

Figure 13:
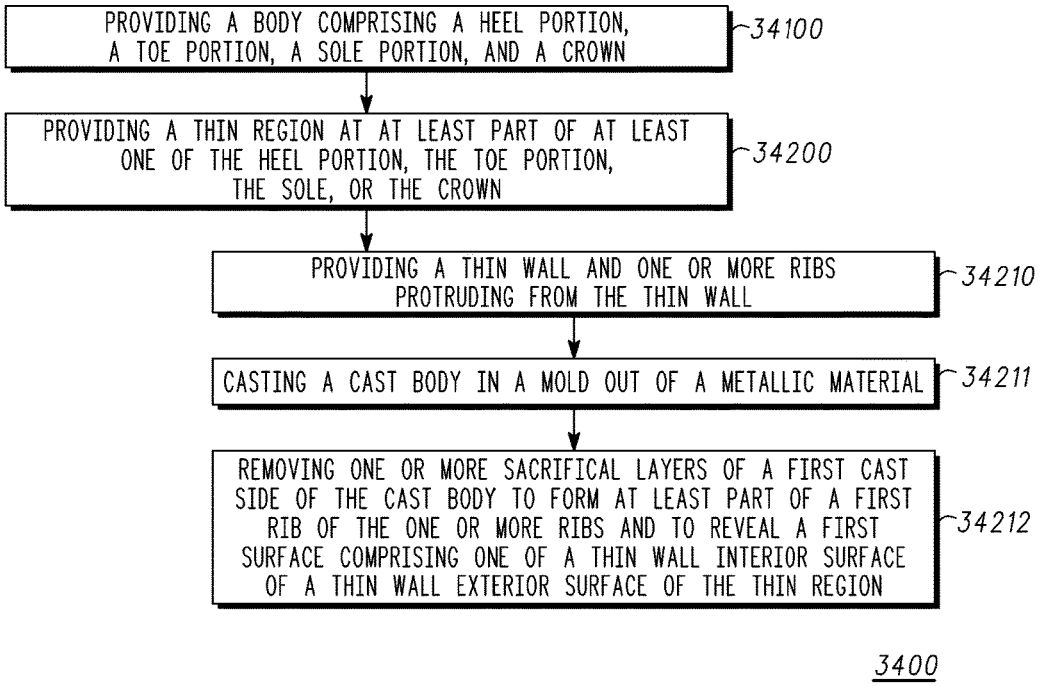
FIG. 13 illustrates a flowchart of a method for providing a golf club head in accordance with examples and embodiments of the present disclosure.

FIG. 13 illustrates a flowchart of a method 34000 for providing a golf club head. In some examples, the golf club head can be similar to one or more of the golf club heads previously described, such as golf club head 220 (FIGS. 22-24), golf club heads with one or more of the ribbed regions or ribs described with respect to FIGS. 26-33, and/or variations thereof.

Block 34100 of method 34000 involves providing a body comprising a heel portion, a toe portion, a sole, and a crown. In some examples, the body and/or the heel portion, the toe portion, the sole, or the crown can be similar to those of the one or more golf club heads described herein.

Block 34200 of method 34000 comprises providing a ribbed region at at least part of at least one of the heel portion, the toe portion, the sole, or the crown of block 34100. In some examples, the ribbed region can be similar to one or more of ribbed region 2210 (FIG. 1), ribbed region 2320 (FIG. 2), ribbed region 2330 (FIG. 2), ribbed region 260 (FIGS. 26-27), ribbed region 280 (FIGS. 28-29), ribbed region 300 (FIGS. 30-31) and/or ribbed region 320 (FIGS. 32-33).

Block 34200 can comprise block 34210 in some examples, where block 34210 comprises providing a ribbed wall and one or more ribs protruding from the ribbed wall. In some embodiments, the ribbed wall can be similar to ribbed wall 2212 (FIGS. 22-24), and/or can be similar to ribbed wall 265 as described with respect to FIGS. 26-33. In the same or other embodiments, the one or more ribs can be similar to one or more of ribs 2211 (FIG. 1), ribs 2321 (FIG. 2), or ribs 2331 (FIG. 2), and/or can be similar to rib 261 (FIG. 5-27), rib 281 (FIGS. 28-29), rib 301 (FIGS. 30-31), or rib 321 (FIGS. 32-33).

Figure 14:
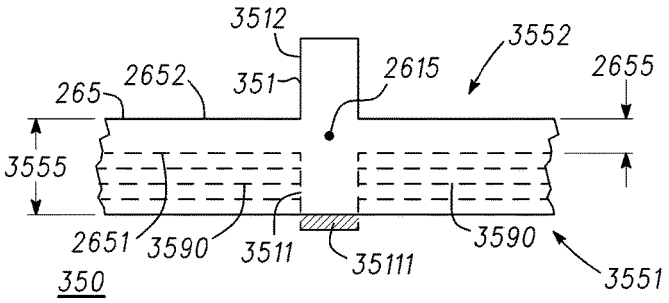
FIG. 14 illustrates a transverse cross-sectional view of a cast body that can be used to form a golf club head ribbed region similar to one or more of the ribbed regions of FIGS. 1-13.

In some examples, providing the ribbed wall and the one or more ribs in block 34210 can be accomplished via blocks 34211 and 34212. Block 34211 comprises casting a cast body in a mold out of a metallic material. FIG. 14 illustrates a transverse cross-sectional view of cast body 350, which can be similar to the cast body of block 34211 of method 34000, and which can be used to form ribbed regions similar to one or more of ribbed region 2210 (FIG. 1), ribbed region 2320 (FIG. 2), ribbed region 2330 (FIG. 2), ribbed region 260 (FIGS. 26-27), ribbed region 280 (FIGS. 28-29), ribbed region 300 (FIGS. 30-31) and/or ribbed region 320 (FIGS. 32-33). In some examples, a metallic material of cast body 350 can comprise a titanium material. Cast body 350 comprises cast side 3551 and cast side 3552 opposite cast side 3551.

In the present example, cast side 3552 comprises rib exterior section 3512 of rib 351, which can be similar to one or more of the rib exterior sections of the ribs of FIGS. 22-33, such as rib exterior section 2612 of rib 261 (FIGS. 26-27). Cast side 3552 also comprises ribbed wall exterior surface 2652 of ribbed wall 265. Rib exterior section 3512 and/or ribbed wall exterior surface 2652 can be directly cast via a casting mold during the casting of cast body 350, but can also be formed in a manner similar to the following description for the formation of rib interior section 3511 and ribbed wall interior surface 2651.

Block 34212 of method 34000 (FIG. 13) comprises removing one or more sacrificial layers of a first cast side of the cast body to form at least part of a first rib of the one or more ribs and to reveal a first surface comprising one of a ribbed wall interior surface or a ribbed wall exterior surface of the ribbed region. With respect to the example of FIG. 14, the first cast side can be similar to side 3551 of cast body 350, the one or more sacrificial layers can be similar to one or more sacrificial layers 3590, the part of the first rib can be similar to at least part of rib interior section 3511 of rib 351, and the first surface can be similar to ribbed wall interior surface 2651. In another example, the first cast side can be similar to cast side 3552, the part of the first rib can be similar to at least part of rib exterior section 3512 of rib 351, and the first surface can be similar to ribbed wall exterior surface 2652.

In block 34212 (FIG. 13), removing the one or more sacrificial layers of the first cast side can be carried out via a chemical etch process. With respect to the example of FIG. 14, mask 35111 can be applied to the outer edge of rib interior section 3511, and then a chemical etchant can be applied to cast side 3551 to remove sacrificial layers 3590 through to ribbed wall interior surface 2651. In some examples, mask 35111 can comprise a polyurethane paint material, a resistive film, a wax material, a tar material, a grease material, or other resistive material. In the same or other examples, the chemical etchant used for the chemical etch process can comprise, for instance, hydrofluoric acid. In one implementation, where the material of cast body 350 is a titanium material, the hydrofluoric acid chemical etchant can etch through such titanium material at a rate of approximately 0.25 mm in approximately 25 minutes. In other examples, the one or more sacrificial layers can be removed from cast body 350 by other methods, such as via machining, laser etching, electrical discharge machining, electro chemical machining and/or via abrasive polishing.

In some examples, the ability to cast a cast body like cast body 350 (FIG. 14) and then remove sacrificial layers like sacrificial layers 3590 can permit the creation of reinforced ribbed walls, like ribbed wall 265 with ribs similar to those described in one or more of FIGS. 22-35, where such reinforced ribbed walls can be thinner than would otherwise be feasible via casting alone. For example, cast body 350 can comprise cast wall thickness 3555 (FIG. 14) of up to approximately 1.03 mm between cast sides 3551 and 3552 in some examples, where cast wall thickness 3555 is approximately 0.53 mm to approximately 0.64 mm in the present embodiment. Casting a wall thickness thinner than that described above for cast wall thickness 3555 can be increasingly difficult, however, as it becomes harder for molten metallic material to flow into or through narrower casting mold conduits and/or to consistently or properly fill corresponding smaller mold crevices in the casting mold. With the minimum thickness for cast wall thickness 3555 constrained by such limitations of the casting process as described above, further reduction in wall thickness can be accomplished via the sacrificial layer removal methodology described above, thus permitting the formation of ribbed wall 265 with thinner ribbed wall thickness 2655. The ability to further remove sacrificial layers such as sacrificial layers 3590 thus permits the formation of thinner and lighter ribbed regions, which can comprise reinforcement ribs as described above for structural integrity and/or durability. In addition, the removal of sacrificial layers 3590 permits the repositioning of mass to other areas of the golf club head for better performance without increasing the total mass of the golf club head.

There can be examples where different blocks of method 34000 can be combined into a single block or performed simultaneously, and/or where the sequence of such blocks can be changed. For example, block 34211 can be carried out simultaneously with block 34100 in some examples. There can also be examples where method 2000 can comprise further or different blocks. As an example, method 34000 can comprise another block for coupling a faceplate to the body of block 34100. Other variations can be implemented for method 34000 without departing from the scope of the present disclosure.

Although the golf club heads with ribs and related methods herein have been described with reference to specific embodiments, various changes may be made without departing from the spirit or scope of the present disclosure. As an example, one embodiment can comprise ribs similar to one or more of rib 261 (FIGS. 5-6), rib 281 (FIGS. 7-8), rib 301 (FIGS. 9-10), and/or rib 321 (FIG. 11), where such one or more ribs can protrude only from one of ribbed wall exterior surface 2652 or ribbed wall interior surface 2651. Another example can comprise a golf club head similar to golf club head 220 (FIG. 3), but lacking at least one of ribbed region 2210 (FIG. 1), ribbed region 2320 (FIG. 2) or ribbed region 2330 (FIG. 2). Another example can comprise a golf club head similar to golf club head 220 (FIG. 3), but without sole thick region 23041 and with ribbed regions 2320 and 2330 merged together. In another example, one or both of ribbed regions 2320 and/or 2330 can be located only at skirt 2305, without extending to sole 2304.

Additional examples have been given in the foregoing description. Other permutations of the different embodiments having one or more of the features of the various figures are likewise contemplated. Accordingly, the disclosure herein is intended to be illustrative and is not intended to be limiting. It is intended that the scope of this application shall be limited only to the extent required by the appended claims.

The golf club heads with ribs and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:
a heel portion comprising a heel end;
a toe portion comprising a toe end;
a sole;
a crown; and
a ribbed region comprising at least part of at least one of the heel portion, the toe portion, the sole, or the crown;
wherein:
the ribbed region comprises:
a ribbed wall comprising:
a ribbed wall interior surface facing an interior of the golf club head; and
a ribbed wall exterior surface facing an exterior of the golf club head opposite the ribbed wall interior surface;
and
one or more ribs protruding from the ribbed wall and comprising:
a first rib comprising:
a first rib length measured along a rib centerline of the first rib;
a first rib interior section, located at the ribbed wall interior surface, and extended along the first rib length;
wherein:
the first rib interior section protrudes past the ribbed wall interior surface throughout the first rib length; and
a first rib exterior section, located at the ribbed wall exterior surface, and extended along the first rib length opposite the first rib interior section;
wherein:
the first rib exterior section protrudes past the ribbed wall exterior surface throughout the first rib length;
the first rib interior section comprises a first rib interior width; and
the first rib exterior section comprises a first rib exterior width;
wherein
one or more of the first rib exterior width and the first rib interior width varies along the first rib length.

2. The golf club head of claim 1, wherein:
the first rib interior width as measured at any point along the first rib length is between approximately 0.76 mm and approximately 1.9 mm while the first rib exterior width as measured at any point along the first rib length is less than 0.76 mm.

3. The golf club head of claim 1, wherein:
the ribbed region comprises:
a first ribbed wall thickness of approximately 0.13 mm to approximately 1.27 mm between the ribbed wall interior surface and the ribbed wall exterior surface; and
the first rib interior section comprises
a first rib interior height;
the first rib interior height, as measured at any point along the first rib length, is no more than approximately 2.5 mm past the ribbed wall interior surface; and
the first rib exterior section comprises
a first rib exterior height;
the first rib exterior height, as measured at any point along the first rib length, is no more than approximately 2.5 mm past the ribbed wall exterior surface.

4. The golf club head of claim 3, wherein
the first rib exterior height is substantially constant along the majority of the first rib length; and
the first rib interior height is substantially constant along the majority of the first rib length.

5. The golf club head of claim 1, wherein:
the ribbed region comprises at least part of the sole; and
the ribbed region comprises at least part of the crown.

6. The golf club head of claim 1, further comprising:
a skirt between the sole and the crown;
a second ribbed region comprising at least part of the sole and having a second ribbed wall thickness of approximately 0.13 mm to approximately 1.27 mm;
a third ribbed region comprising at least part of the sole and having a third ribbed wall thickness of approximately 0.13 mm to approximately 1.27 mm; and
a sole thick region located at the sole and separating the second ribbed region from the third ribbed region;
wherein:
the sole thick region has a thickness of approximately 0.5 mm to approximately 6.35 mm;
the second ribbed region extends to the skirt and is located at the toe portion of the golf club head; and
the third ribbed region extends to the skirt and is located at the heel portion of the golf club head.

7. The golf club head of claim 1, wherein:
the one or more ribs comprise a plurality of ribs including the first rib; and
each rib of the plurality of ribs protrudes towards the interior of the golf club head past the ribbed wall interior surface; and
each rib of the plurality of ribs protrudes towards the exterior of the golf club head past the ribbed wall exterior surface.

8. The golf club head of claim 1, wherein:
the sole comprises:
a sole thick region located between the heel portion and the toe portion and comprising a thickness greater than the ribbed region and less than or equal to a first rib thickness of the first rib;

a sole-heel region located between the sole thick region and the heel end; and a sole-toe region located between the sole thick region and the toe end;

the ribbed region is located outside the sole thick region and comprises at least one of:

the sole-heel region; or the sole-toe region.

9. The golf club head of claim 1, wherein the first rib interior sections and the first rib exterior sections are collinear to each other.

10. The golf club head of claim 1, wherein the first rib interior section comprises a first rib interior height;

the first rib exterior section comprises a first rib exterior height; and one or more of the first rib interior height and the second rib interior height vary along the first rib length.

11. A golf club head comprising:

a heel portion comprising a heel end;

a toe portion comprising a toe end;

a sole;

a crown; and a ribbed region comprising at least part of at least one of the heel portion, the toe portion, the sole, or the crown;

wherein:

the ribbed region comprises:

a ribbed wall comprising:

a ribbed wall interior surface facing an interior of the golf club head; and a ribbed wall exterior surface facing an exterior of the golf club head opposite the ribbed wall interior surface;

one or more ribs protruding from the ribbed wall and comprising:

a first rib comprising:

a first rib length measured along a rib centerline of the first rib;

a first rib interior section, located at the ribbed wall interior surface, and extended along the first rib length;

wherein:

the first rib interior section protrudes past the ribbed wall interior surface throughout the first rib length;

the first rib interior section comprises a first rib interior height;

and a first rib exterior section, located at the ribbed wall exterior surface, and extended along the first rib length opposite the first rib interior section;

wherein:

the first rib exterior section protrudes past the ribbed wall exterior surface throughout the first rib length;

the first rib exterior section comprises a first rib exterior height; and one or more of the first rib interior height and the first rib exterior height vary along the first rib length.

12. The golf club head of claim 11, wherein:

the ribbed region comprises:

a first ribbed wall thickness of approximately 0.13 mm to approximately 1.27 mm between the ribbed wall interior surface and the ribbed wall exterior surface; and the first rib interior section comprises a first rib interior width;

the first rib interior width, as measured at any point along the first rib length, is between approximately 0.76 mm and approximately 1.9 mm;

the first rib exterior section comprises a first rib exterior width; and the first rib exterior width, as measured at any point along the first rib length, is less than approximately 0.76 mm.

13. The golf club head of claim 12, wherein the first rib exterior width is substantially constant along the majority of the first rib length; and the first rib interior width is substantially constant along the majority of the first rib length.

14. The golf club head of claim 11, wherein:

the ribbed region comprises at least part of the sole; and the ribbed region comprises at least part of the crown.

15. The golf club head of claim 11, further comprising:

a skirt between the sole and the crown;

a second ribbed region comprising at least part of the sole and having a second ribbed wall thickness of approximately 0.13 mm to approximately 1.27 mm;

a third ribbed region comprising at least part of the sole and having a third ribbed wall thickness of approximately 0.13 mm to approximately 1.27 mm; and a sole thick region located at the sole and separating the second ribbed region from the third ribbed region;

wherein:

the sole thick region has a thickness of approximately 0.5 mm to approximately 6.35 mm;

the second ribbed region extends to the skirt and is located at the toe portion of the golf club head; and the third ribbed region extends to the skirt and is located at the heel portion of the golf club head.

16. The golf club head of claim 11, wherein:

the one or more ribs comprise a plurality of ribs including the first rib; and each rib of the plurality of ribs protrudes towards the interior of the golf club head past the ribbed wall interior surface; and each rib of the plurality of ribs protrudes towards the exterior of the golf club head past the ribbed wall exterior surface.

17. The golf club head of claim 11, wherein:

the sole comprises:

a sole thick region located between the heel portion and the toe portion and comprising a thickness greater than the ribbed region and less than or equal to a first rib thickness of the first rib;

a sole-heel region located between the sole thick region and the heel end; and a sole-toe region located between the sole thick region and the toe end;

the ribbed region is located outside the sole thick region and comprises at least one of:

the sole-heel region; or the sole-toe region.

18. The golf club head of claim 11, wherein:

the first rib interior height, as measured at any point along the first rib length, is no more than approximately 2.5 mm past the ribbed wall interior surface; and the first rib exterior height, as measured at any point along the first rib length, is no more than approximately 2.5 mm past the ribbed wall interior surface.

19. The golf club head of claim 11, wherein the first rib interior sections and the first rib exterior sections are collinear to each other.

20. The golf club head of claim 11, wherein the first rib interior sections and the first rib exterior sections are offset from each other.

* * * * *